US011721905B2

(12) United States Patent
Shi

(10) Patent No.: US 11,721,905 B2
(45) Date of Patent: Aug. 8, 2023

(54) WAVEGUIDE WITH A BEAM-FORMING FEATURE WITH RADIATION SLOTS

(71) Applicant: Aptiv Technologies Limited, St. Michael (BB)

(72) Inventor: Shawn Shi, Thousand Oaks, CA (US)

(73) Assignee: Aptiv Technologies Limited, St. Michael (BB)

( * ) Notice: Subject to any disclaimer, the term of this patent is extended or adjusted under 35 U.S.C. 154(b) by 0 days.

(21) Appl. No.: 17/371,617

(22) Filed: Jul. 9, 2021

(65) Prior Publication Data

US 2022/0302600 A1 Sep. 22, 2022

Related U.S. Application Data

(60) Provisional application No. 63/161,907, filed on Mar. 16, 2021.

(51) Int. Cl.
*H01Q 13/02* (2006.01)
*H01Q 1/32* (2006.01)
(Continued)

(52) U.S. Cl.
CPC ..... *H01Q 13/0233* (2013.01); *H01Q 1/3233* (2013.01); *H01Q 13/18* (2013.01); *H01Q 21/0043* (2013.01)

(58) Field of Classification Search
CPC ..... H01Q 1/3233; H01Q 21/0043; H01Q 21/005; H01Q 21/064; H01Q 13/18;
(Continued)

(56) References Cited

U.S. PATENT DOCUMENTS 3,032,762 A 5/1962 Kerr
3,328,800 A 6/1967 Algeo
(Continued)

FOREIGN PATENT DOCUMENTS

CA 2654470 12/2007
CN 1620738 5/2005
(Continued)

OTHER PUBLICATIONS

D. A. Schneider, M. Rösch, A. Tessmann and T. Zwick, "A Low-Loss W-Band Frequency-Scanning Antenna for Wideband Multichannel Radar Applications," in IEEE Antennas and Wireless Propagation Letters, vol. 18, No. 4, pp. 806-810, Apr. 2019 (Year: 2019).*

(Continued)

*Primary Examiner* — Robert Karacsony
(74) *Attorney, Agent, or Firm* — Sawtooth Patent Group PLLC

(57) ABSTRACT

This document describes a waveguide with a beam-forming feature with radiation slots. The beam-forming feature of the waveguide includes recessed walls surrounding a plurality of radiation slots. The recessed walls of the waveguide may be walls of equal height and width, or they may include further features that manipulate the beam being formed for certain applications. Some examples of these further features are the inclusion of a choke on one wall, one wall having a height greater than a parallel wall, or the walls either including a step or a taper, such that the beam-forming feature is narrower near the surface of the waveguide with the radiation slots and wider further from the surface of the waveguide with the radiation slots. The beam-forming feature may reduce grating lobes in the radiation pattern thereby improving accuracy and performance of the host system.

20 Claims, 13 Drawing Sheets

(51) Int. Cl.
*H01Q 13/18* (2006.01)
*H01Q 21/00* (2006.01)

(58) Field of Classification Search
CPC .. H01Q 13/0233; H01Q 13/065; H01Q 13/22; H01Q 21/0037; G01S 7/03; G01S 13/931
See application file for complete search history.

(56) References Cited

U.S. PATENT DOCUMENTS

| | | | |
|---|---|---|---|
| 3,462,713 | A | 8/1969 | Knerr |
| 3,579,149 | A | 5/1971 | Ramsey |
| 3,594,806 | A | 7/1971 | Black et al. |
| 4,157,516 | A | 6/1979 | Van De Grijp |
| 4,453,142 | A | 6/1984 | Murphy |
| 4,562,416 | A | 12/1985 | Sedivec |
| 4,590,480 | A | 5/1986 | Nikolayuk et al. |
| 5,030,965 | A | 7/1991 | Park et al. |
| 5,638,079 | A | 6/1997 | Kastner et al. |
| 5,982,256 | A | 11/1999 | Uchimura et al. |
| 5,986,527 | A | 11/1999 | Ishikawa et al. |
| 6,166,701 | A | 12/2000 | Park et al. |
| 6,489,855 | B1 | 12/2002 | Kitamori et al. |
| 6,794,950 | B2 | 9/2004 | Du Toit et al. |
| 6,867,660 | B2 | 3/2005 | Kitamori et al. |
| 6,958,662 | B1 | 10/2005 | Salmela et al. |
| 7,091,919 | B2 | 8/2006 | Bannon |
| 7,973,616 | B2 | 7/2011 | Shijo et al. |
| 7,994,879 | B2 | 8/2011 | Kim et al. |
| 8,013,694 | B2 | 9/2011 | Hiramatsu et al. |
| 8,089,327 | B2 | 1/2012 | Margomenos et al. |
| 8,159,316 | B2 | 4/2012 | Miyazato et al. |
| 8,604,990 | B1 | 12/2013 | Chen et al. |
| 8,692,731 | B2 | 4/2014 | Lee et al. |
| 9,007,269 | B2 | 4/2015 | Lee et al. |
| 9,203,139 | B2 | 12/2015 | Zhu et al. |
| 9,450,281 | B2 | 9/2016 | Kim |
| 9,673,532 | B2 | 6/2017 | Cheng et al. |
| 9,935,065 | B1 | 4/2018 | Baheti et al. |
| 10,283,832 | B1 | 5/2019 | Chayat et al. |
| 10,381,741 | B2 * | 8/2019 | Kirino ..... H01Q 21/005 |
| 10,468,736 | B2 | 11/2019 | Mangaiahgari |
| 10,775,573 | B1 | 9/2020 | Hsu et al. |
| 10,833,385 | B2 | 11/2020 | Mangaiahgari et al. |
| 11,349,220 | B2 | 5/2022 | Alexanian et al. |
| 11,444,364 | B2 | 9/2022 | Shi |
| 2002/0021197 | A1 | 2/2002 | Elco |
| 2003/0052828 | A1 | 3/2003 | Scherzer et al. |
| 2004/0069984 | A1 | 4/2004 | Estes et al. |
| 2004/0090290 | A1 | 5/2004 | Teshirogi et al. |
| 2005/0237253 | A1 | 10/2005 | Kuo et al. |
| 2006/0113598 | A1 | 6/2006 | Chen et al. |
| 2007/0013598 | A1 | 1/2007 | Artis et al. |
| 2007/0054064 | A1 | 3/2007 | Ohmi et al. |
| 2008/0129409 | A1 | 6/2008 | Nagaishi et al. |
| 2008/0150821 | A1 | 6/2008 | Koch et al. |
| 2009/0207090 | A1 | 8/2009 | Pettus et al. |
| 2009/0243762 | A1 | 10/2009 | Chen et al. |
| 2010/0321265 | A1 | 12/2010 | Yamaguchi et al. |
| 2012/0013421 | A1 | 1/2012 | Hayata |
| 2012/0050125 | A1 | 3/2012 | Leiba et al. |
| 2012/0068316 | A1 | 3/2012 | Ligander |
| 2012/0163811 | A1 | 6/2012 | Doany et al. |
| 2012/0242421 | A1 | 9/2012 | Robin et al. |
| 2012/0256796 | A1 | 10/2012 | Leiba |
| 2013/0057358 | A1 | 3/2013 | Anthony et al. |
| 2014/0015709 | A1 | 1/2014 | Shijo et al. |
| 2014/0091884 | A1 | 4/2014 | Flatters |
| 2014/0106684 | A1 | 4/2014 | Burns et al. |
| 2015/0097633 | A1 | 4/2015 | Devries et al. |
| 2015/0229017 | A1 | 8/2015 | Suzuki et al. |
| 2015/0357698 | A1 | 12/2015 | Kushta |
| 2015/0364804 | A1 | 12/2015 | Tong et al. |
| 2015/0364830 | A1 | 12/2015 | Tong et al. |
| 2016/0043455 | A1 | 2/2016 | Seler et al. |
| 2016/0049714 | A1 | 2/2016 | Ligander et al. |
| 2016/0118705 | A1 | 4/2016 | Tang et al. |
| 2016/0126637 | A1 | 5/2016 | Uemichi |
| 2016/0204495 | A1 | 7/2016 | Takeda et al. |
| 2016/0276727 | A1 | 9/2016 | Dang et al. |
| 2016/0293557 | A1 | 10/2016 | Topak et al. |
| 2016/0301125 | A1 | 10/2016 | Kim et al. |
| 2017/0003377 | A1 | 1/2017 | Menge |
| 2017/0084554 | A1 | 3/2017 | Dogiamis et al. |
| 2017/0324135 | A1 | 11/2017 | Blech et al. |
| 2018/0013208 | A1 | 1/2018 | Izadian et al. |
| 2018/0131084 | A1 | 5/2018 | Park et al. |
| 2018/0226709 | A1 | 8/2018 | Mangaiahgari |
| 2018/0233465 | A1 | 8/2018 | Spella et al. |
| 2018/0284186 | A1 | 10/2018 | Chadha et al. |
| 2018/0301819 | A1 | 10/2018 | Kirino et al. |
| 2018/0343711 | A1 | 11/2018 | Wixforth et al. |
| 2018/0351261 | A1 | 12/2018 | Kamo et al. |
| 2019/0006743 | A1 | 1/2019 | Kirino et al. |
| 2019/0013563 | A1 | 1/2019 | Takeda et al. |
| 2019/0187247 | A1 | 6/2019 | Izadian et al. |
| 2019/0245276 | A1 | 8/2019 | Li et al. |
| 2019/0252778 | A1 | 8/2019 | Duan |
| 2020/0021001 | A1 | 1/2020 | Mangaiahgairi |
| 2020/0044360 | A1 | 2/2020 | Kamo et al. |
| 2020/0112077 | A1 * | 4/2020 | Kamo ..... G01S 7/032 |
| 2020/0203849 | A1 | 6/2020 | Lim et al. |
| 2020/0212594 | A1 | 7/2020 | Kirino et al. |
| 2020/0235453 | A1 | 7/2020 | Lang |
| 2020/0287293 | A1 | 9/2020 | Shi et al. |
| 2020/0319293 | A1 | 10/2020 | Kuriyama et al. |
| 2020/0343612 | A1 | 10/2020 | Shi |
| 2021/0028528 | A1 | 1/2021 | Alexanian et al. |
| 2021/0036393 | A1 | 2/2021 | Mangaiahgari |

FOREIGN PATENT DOCUMENTS

| | | | |
|---|---|---|---|
| CN | 2796131 | | 7/2006 |
| CN | 201383535 | | 1/2010 |
| CN | 102157787 | A | 8/2011 |
| CN | 102420352 | A | 4/2012 |
| CN | 103515682 | | 1/2014 |
| CN | 104900956 | | 9/2015 |
| CN | 105609909 | | 5/2016 |
| CN | 105680133 | | 6/2016 |
| CN | 105958167 | | 9/2016 |
| CN | 109980361 | A | 7/2019 |
| CN | 209389219 | | 9/2019 |
| CN | 110401022 | A | 11/2019 |
| DE | 112017006415 | | 9/2019 |
| DE | 102019200893 | | 7/2020 |
| EP | 2500978 | | 9/2012 |
| EP | 2843758 | | 3/2015 |
| EP | 3460903 | | 3/2019 |
| EP | 4089840 | A1 | 11/2022 |
| GB | 2463711 | A | 3/2010 |
| GB | 2489950 | | 10/2012 |
| JP | 2003289201 | | 10/2003 |
| JP | 2013187752 | A | 9/2013 |
| KR | 100846872 | | 5/2008 |
| KR | 1020080044752 | A | 5/2008 |
| WO | 9934477 | A1 | 7/1999 |
| WO | 2013189513 | | 12/2013 |
| WO | 2018003932 | | 1/2018 |

OTHER PUBLICATIONS

"Foreign Office Action", CN Application No. 201810122408.4, dated Jun. 2, 2021, 15 pages.
"Extended European Search Report", EP Application No. 18153137.7, dated Jun. 15, 2018, 8 pages.
"Extended European Search Report", EP Application No. 20166797, dated Sep. 16, 2020, 11 pages.
"Non-Final Office Action", U.S. Appl. No. 16/583,867, dated Feb. 18, 2020, 8 pages.
"Non-Final Office Action", U.S. Appl. No. 15/427,769, dated Nov. 13, 2018, 8 pages.
"Notice of Allowance", U.S. Appl. No. 15/427,769, dated Jun. 28, 2019, 9 pages.

(56) References Cited

OTHER PUBLICATIONS

"Notice of Allowance", U.S. Appl. No. 16/583,867, dated Jul. 8, 2020, 8 pages.
Jankovic, et al., "Stepped Bend Substrate Integrated Waveguide to Rectangular Waveguide Transitions", Jun. 2016, 2 pages.
"Foreign Office Action", CN Application No. 201810122408.4, dated Oct. 18, 2021, 19 pages.
"Non-Final Office Action", U.S. Appl. No. 16/829,409, dated Oct. 14, 2021, 13 pages.
"Non-Final Office Action", U.S. Appl. No. 17/061,675, dated Dec. 20, 2021, 4 pages.
Wang, et al., "Mechanical and Dielectric Strength of Laminated Epoxy Dielectric Graded Materials", Mar. 2020, 15 pages.
"Extended European Search Report", EP Application No. 21211165.2, dated May 13, 2022, 12 pages.
"Extended European Search Report", EP Application No. 21211167.8, dated May 19, 2022, 10 pages.
"Extended European Search Report", EP Application No. 21211168.6, dated May 13, 2022, 11 pages.
"Extended European Search Report", EP Application No. 21211452.4, dated May 16, 2022, 10 pages.
"Extended European Search Report", EP Application No. 21211478.9, dated May 19, 2022, 10 pages.
"Extended European Search Report", EP Application No. 21212703.9, dated May 3, 2022, 13 pages.
"WR-90 Waveguides", Pasternack Enterprises, Inc., 2016, Retrieved from https://web.archive.org/web/20160308205114/http://www.pasternack.com:80/wr-90-waveguides-category.aspx, 2 pages.
Alhuwaimel, et al., "Performance Enhancement of a Slotted Waveguide Antenna by Utilizing Parasitic Elements", Sep. 7, 2015, pp. 1303-1306.
Gray, et al., "Carbon Fibre Reinforced Plastic Slotted Waveguide Antenna", Proceedings of Asia-Pacific Microwave Conference 2010, pp. 307-310.
Huang, et al., "The Rectangular Waveguide Board Wall Slot Array Antenna Integrated with One Dimensional Subwavelength Periodic Corrugated Grooves and Artificially Soft Surface Structure", Dec. 20, 2008, 10 pages.
Li, et al., "Millimetre-wave slotted array antenna based on double-layer substrate integrated waveguide", Jun. 1, 2015, pp. 882-888.
Mak, et al., "A Magnetoelectric Dipole Leaky-Wave Antenna for Millimeter-Wave Application", Dec. 12, 2017, pp. 3395-6402.
Mallahzadeh, et al., "A Low Cross-Polarization Slotted Ridged SIW Array Antenna Design With Mutual Coupling Considerations", Jul. 17, 2015, pp. 4324-4333.
Razmhosseini, et al., "Parasitic Slot Elements for Bandwidth Enhancement of Slotted Waveguide Antennas", 2019 IEEE 90th Vehicular Technology Conference, Sep. 2019, 5 pages.
Rossello, et al., "Substrate Integrated Waveguide Aperture Coupled Patch Antenna Array for 24 GHz Wireless Backhaul and Radar Applications", Nov. 16, 2014, 2 pages.
Shehab, et al., "Substrate-Integrated-Waveguide Power Dividers", Oct. 15, 2019, pp. 27-38.
Wu, et al., "A Planar W-Band Large-Scale High-Gain Substrate-Integrated Waveguide Slot Array", Feb. 3, 2020, pp. 3429-6434.
Xu, et al., "CPW Center-Fed Single-Layer SIW Slot Antenna Array for Automotive Radars", Jun. 12, 2014, pp. 4528-4536.
"Extended European Search Report", EP Application No. 22160898.7, dated Aug. 4, 2022, 11 pages.
Ogiwara, et al., "2-D MoM Analysis of the Choke Structure for Isolation Improvement between Two Waveguide Slot Array Antennas", Proceedings of Asia-Pacific Microwave Conference 2007, 4 pages.

* cited by examiner

WAVEGUIDE WITH A BEAM-FORMING FEATURE WITH RADIATION SLOTS

CROSS-REFERENCE TO RELATED APPLICATIONS

This application claims the benefit under 35 U.S.C. 119(e) of U.S. Provisional Application No. 63/161,907, filed Mar. 16, 2021, the disclosure of which is incorporated by reference in its entirety herein.

BACKGROUND

Waveguides are often utilized by detection and tracking systems (e.g., radar systems) to transmit or receive electromagnetic signals. The waveguides may improve the radiation pattern of the signals being transmitted or received. However, some waveguides may produce one or more grating lobes, in addition to the main lobe, in the radiation pattern. These grating lobes can adversely affect the accuracy of the detection and tracking system. For example, an automobile equipped with a radar system having a waveguide that produces grating lobes may incorrectly detect the position of a pedestrian in relation to another vehicle. Reducing the grating lobes generated by a waveguide may improve the detection and tracking system accuracy and improve the accuracy of autonomous and semi-autonomous vehicle systems.

SUMMARY

This document describes techniques, apparatuses, and systems for a waveguide with a beam-forming feature with radiation slots. The waveguide may be configured to guide electromagnetic energy through an opening at one end of at least one channel filled with a dielectric. The waveguide includes two parallel surfaces that form a ceiling and a floor of the channel filled with the dielectric. An adjoining surface orthogonal to the two surfaces may form walls of the channel filled with the dielectric. The waveguide further includes a beam-forming feature that defines one or more recessed walls surrounding to provide a recessed surface through which a plurality of radiation slots include openings to the channel filled with the dielectric. The beam-forming feature shapes the radiation pattern of the electromagnetic energy and may reduce grating lobes, which may increase the accuracy of a system equipped with said waveguide.

This document also describes methods performed by the above-summarized techniques, apparatuses, and systems, and other methods set forth herein, as well as means for performing these methods.

This Summary introduces simplified concepts related to a waveguide with a beam-forming feature with radiation slots, further described in the Detailed Description and Drawings. This Summary is not intended to identify essential features of the claimed subject matter, nor is it intended for use in determining the scope of the claimed subject matter.

BRIEF DESCRIPTION OF THE DRAWINGS

The details of one or more aspects of a waveguide with a beam-forming feature with radiation slots are described in this document with reference to the following figures. The same numbers are often used throughout the drawings to reference like features and components:

FIG. 1-2 illustrates an example configuration of a vehicle that can use a waveguide with a beam-forming feature with radiation slots, in accordance with techniques, apparatuses, and systems of this disclosure;

FIG. 2 illustrates a detailed view of a waveguide with a beam-forming feature with radiation slots, in accordance with techniques, apparatuses, and systems of this disclosure;

FIGS. 3-1 and 3-2 illustrate radiation patterns associated with example waveguides without and with a beam-forming feature with radiation slots, in accordance with techniques, apparatuses, and systems of this disclosure;

FIG. 4-1 illustrates a top view of a waveguide with a beam-forming feature with radiation slots, in accordance with techniques, apparatuses, and systems of this disclosure;

FIG. 4-2 illustrates a lateral cross-section view of a waveguide with a beam-forming feature with radiation slots, in accordance with techniques, apparatuses, and systems of this disclosure;

FIG. 4-3 illustrates a longitudinal cross-section view of a waveguide with a beam-forming feature with radiation slots, in accordance with techniques, apparatuses, and systems of this disclosure;

DETAILED DESCRIPTION

Overview

Figure 1:
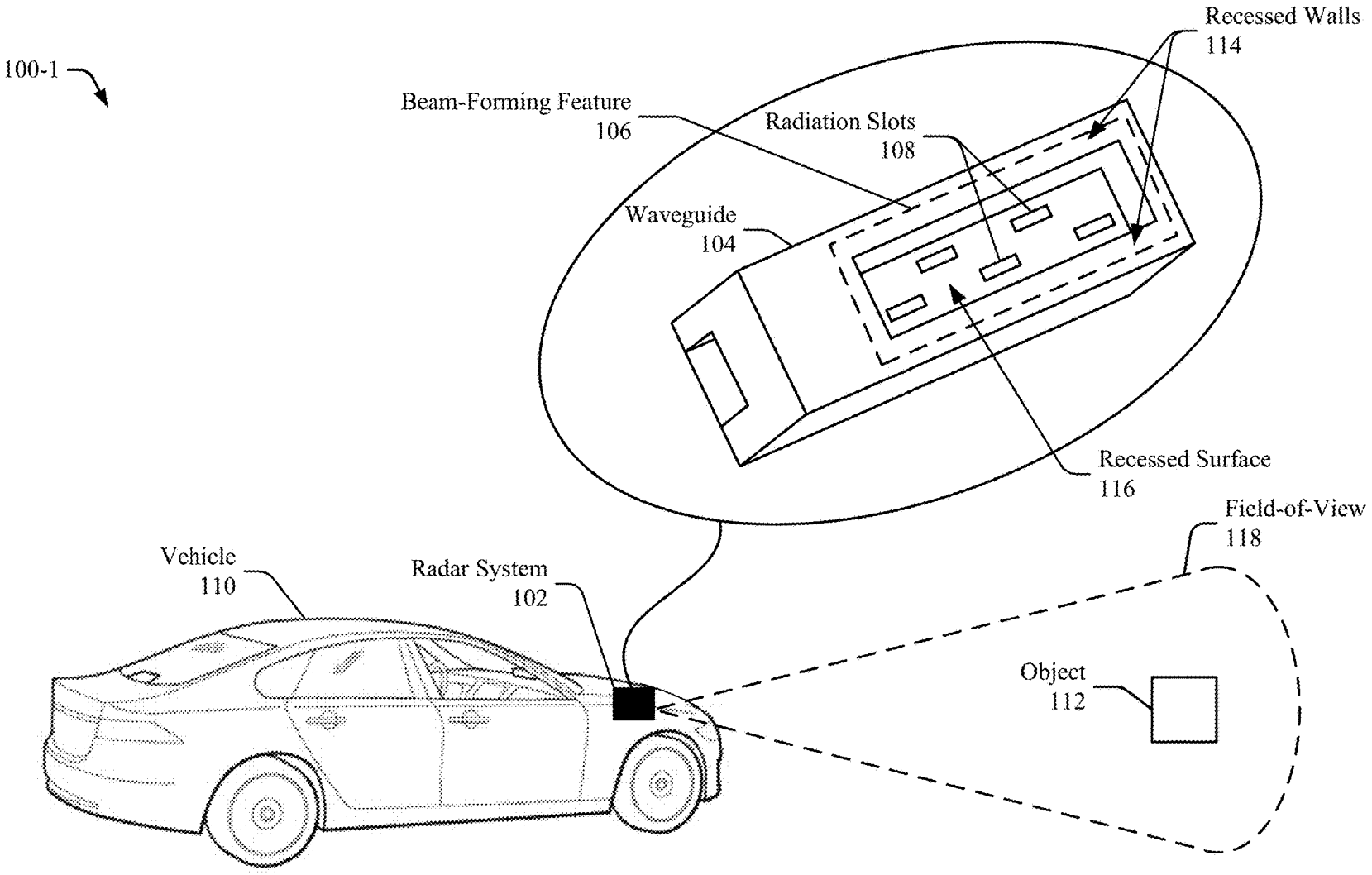
FIG. 1-1 illustrates an example environment in which a waveguide with a beam-forming feature with radiation slots is used on a vehicle, in accordance with techniques, apparatuses, and systems of this disclosure.

Radar systems are a sensing technology that some automotive systems rely on to acquire information about the surrounding environment. Radar systems generally use an antenna or waveguide to direct electromagnetic energy for transmission or reception. Such radar systems may use any combination of antennas and waveguides to provide increased gain and directivity. As the automotive industry increasingly utilizes radar systems, the need to reduce grating lobes generated by waveguides and, thus, increase the system accuracy becomes more important for manufacturers.

Consider a waveguide used to transfer electromagnetic energy to and from a host system (e.g., a radar system). The waveguide generally includes an array of radiation slots representing apertures in the waveguide. Manufacturers may select the number and arrangement of the radiation slots to provide the desired phasing, combining, or splitting of electromagnetic energy. For example, the radiation slots are equally spaced in a waveguide surface along a propagation direction of the electromagnetic energy. This arrangement of radiation slots generally provides a radiation pattern represented by a main lobe. However, due to the electromagnetic properties of a slot-array waveguide, the radiation pattern may also include undesired grating lobes. The grating lobes may lessen the accuracy of the host system. For example, a sensor of an automobile emits a radiation pattern with multiple grating lobes into an area near the automobile. Instead of using the main lobe to detect a pedestrian, the radar system uses a grating lobe to detect the pedestrian. In this situation, the automobile can incorrectly infer that the detection is in response to the main lobe, when, it was in response to the grating lobe. The automobile incorrectly determines the location of the pedestrian based on the grating lobe. The automobile determines that the pedestrian is standing next to the automobile, but instead, the pedestrian is standing in front of the automobile. In this manner, grating lobes may cause the host system to report an object in a location and moving at a velocity that is different than the actual location and velocity of the object being detected. The grating lobes may also cause false-positive detections of objects not in a field-of-view of the waveguide. Reducing grating lobes and shaping a radiation pattern (e.g., radiation beam or main lobe) may, therefore, improve the accuracy of object detection.

This document describes a waveguide with a beam-forming feature with radiation slots. The beam-forming feature of the waveguide includes recessed walls surrounding a plurality of radiation slots. The recessed walls of the waveguide may be walls of equal height and width, or they may include further features that manipulate the beam for certain applications. The further features can include a choke on one wall, one wall having a height greater than a parallel wall, or the walls either including a step or a taper. The taper provides that the beam-forming feature is narrower near the surface of the waveguide with the radiation slots and wider further from the surface of the waveguide with the radiation slots. The beam-forming feature may reduce grating lobes in the radiation pattern thereby improving accuracy and performance of the host system.

A waveguide may be described as generally being any dielectric filled structure to guide electromagnetic energy (one example of a dielectric is air). For ease of description, the waveguides described herein are often referred to as air waveguides, but the described techniques can apply to other types of waveguides that use other dielectric materials for other applications, instead of or in combination with air. Air waveguides are often used in automotive applications located near exterior portions of the vehicle and use the vehicle outer surface to provide a radome that prevents debris from entering the dielectric channels filled with air.

Operating Environment

FIG. 1-1 illustrates an example environment 100-1 in which a radar system 102 with a waveguide 104 with a beam-forming feature 106 with radiation slots 108 is used on a vehicle 110. The vehicle 110 may use one or more waveguides 104 to enable operations of the radar system 102 that is configured to determine a proximity, an angle, or a velocity of one or more objects 112 in the proximity of the vehicle 110.

The beam-forming feature 106 may be defined by one or more recessed walls 114 that extend from a recessed surface 116 of the waveguide 104 that includes the radiation slots 108. Although, the waveguide 104 is depicted with five radiation slots 108, the quantity of radiation slots can be more or less than five. The beam-forming feature 106 surrounds the radiation slots 108 without occluding them in a direction normal to the recessed surface 116 of the waveguide 104 that includes the radiation slots 108. The beam-forming feature 106 shapes the radiation pattern (e.g., a wider, narrower, or asymmetric main lobe of the radiation pattern) of the waveguide 104 and may reduce grating lobes generated by the waveguide 104.

Although illustrated as a car, the vehicle 110 can represent other types of motorized vehicles (e.g., a motorcycle, a bus, a tractor, a semi-trailer truck, or construction equipment), non-motorized vehicles (e.g., a bicycle), railed vehicles (e.g., a train or a trolley car), watercraft (e.g., a boat or a ship), aircraft (e.g., an airplane or a helicopter), or spacecraft (e.g., satellite). In general, manufacturers can mount the radar system 102 to any moving platform, including moving machinery or robotic equipment. In other implementations, other devices (e.g., desktop computers, tablets, laptops, televisions, computing watches, smartphones, gaming systems, and so forth) may incorporate the radar system 102 with the waveguide 104 and support techniques described herein.

In the depicted environment 100-1, the radar system 102 is mounted near, or integrated within, a front portion of the vehicle 110 to detect the object 112 and avoid collisions. The radar system 102 provides a field-of-view 118 towards the one or more objects 112. The radar system 102 can project the field-of-view 118 from any exterior surface of the vehicle 110. For example, vehicle manufacturers can integrate the radar system 102 into a bumper, side mirror, headlights, rear lights, or any other interior or exterior location where the object 112 requires detection. In some cases, the vehicle 110 includes multiple radar systems 102, such as a first radar system 102 and a second radar system 102 that provide a larger field-of-view 118. In general, vehicle manufacturers can design the locations of the one or more radar systems 102 to provide a particular field-of-view 118 that encompasses a region of interest, including, for instance, in or around a travel lane aligned with a vehicle path.

Example fields-of-view 118 include a 360-degree field-of-view, one or more 180-degree fields-of-view, one or more 90-degree fields-of-view, and so forth, which can overlap or be combined into a field-of-view 118 of a particular size. As described above, the described waveguide 104 includes a beam-forming feature 106 to provide a radiation pattern with a particular shape depending on the coverage in the field-of-view 118 required of the waveguide 104. As one example, a radar system placed near the front of a vehicle can use a narrow beam width to focus on detecting objects immediately in front of the vehicle 110 (e.g., in a travel lane aligned with a vehicle path) instead of objects located toward a side of the vehicle 110 (e.g., ahead of the vehicle 110 and in an adjacent travel lane to the vehicle path). For example, the narrow coverage or narrow beam width can concentrate the radiated electromagnetic energy within plus or minus approximately 20 to 45 degrees of a direction following a travel path of the vehicle 110. One or more aspects of the waveguide 104 can be used in other locations on the vehicle 110 to provide other fields-of-view as required.

The object 112 is composed of one or more materials that reflect radar signals. Depending on the application, the object 112 can represent a target of interest. In some cases, the object 112 can be a moving object or a stationary object. The stationary objects can be continuous (e.g., a concrete barrier, a guard rail) or discontinuous (e.g., a traffic cone) along a road portion.

The radar system 102 emits electromagnetic radiation by transmitting one or more electromagnetic signals or waveforms via the waveguide 104. In the environment 100-1, the radar system 102 can detect and track the object 112 by transmitting and receiving one or more radar signals. For example, the radar system 102 can transmit electromagnetic signals between 100 and 400 gigahertz (GHz), between 4 and 100 GHz, or between approximately 70 and 80 GHz.

The radar system 102 can determine a distance to the object 112 based on the time it takes for the signals to travel from the radar system 102 to the object 112 and from the object 112 back to the radar system 102. The radar system 102 can also determine the location of the object 112 in terms of an angle based on the direction of a maximum amplitude echo signal received by the radar system 102.

The radar system 102 can be part of the vehicle 110. The vehicle 110 can also include at least one automotive system that relies on data from the radar system 102, including a driver-assistance system, an autonomous-driving system, or a semi-autonomous driving system. The radar system 102 can include an interface to the automotive systems. The radar system 102 can output, via the interface, a signal based on electromagnetic energy received by the radar system 102.

Generally, the automotive systems use radar data provided by the radar system 102 to perform a function. For example, the driver-assistance system can provide blind-spot monitoring and generate an alert indicating a potential collision with the object 112 detected by the radar system 102. In this case, the radar data from the radar system 102 indicate when it is safe or unsafe to change lanes. The autonomous-driving system may move the vehicle 110 to a particular location on the road while avoiding collisions with the object 112 detected by the radar system 102. The radar data provided by the radar system 102 can provide information about a distance to and the location of the object 112 to enable the autonomous-driving system to perform emergency braking, perform a lane change, or adjust the speed of the vehicle 110.

The radar system 102 generally includes a transmitter (not illustrated) and at least one antenna, including the waveguide 104, to transmit electromagnetic signals. The radar system 102 generally includes a receiver (not illustrated) and at least one antenna, including the waveguide 104, to receive reflected versions of these electromagnetic signals. The transmitter includes components for emitting electromagnetic signals. The receiver includes components to detect the reflected electromagnetic signals. The transmitter and the receiver can be incorporated together on the same integrated circuit (e.g., a transceiver integrated circuit) or separately on different integrated circuits.

The radar system 102 also includes one or more processors (not illustrated) and computer-readable storage media (CRM) (not illustrated). The processor can be a microprocessor or a system-on-chip. The processor executes instructions stored within the CRM. As an example, the processor can control the operation of the transmitter. The processor can also process electromagnetic energy received by the waveguide and determine the location of the object 112 relative to the radar system 102. The processor can also generate radar data for the automotive systems. For example, the processor can control, based on processed electromagnetic energy from the waveguide 104, an autonomous or semi-autonomous driving system of the vehicle 110.

Although depicted as a rectangular shape with two parallel recessed walls 114 of a uniform height and width, the one or more recessed walls 114 of the beam-forming feature 106 may be shaped differently. For example, the beam-forming feature 106 may include rounded corners, a choke, walls of uneven height, or walls that are more recessed farther away from the recessed surface 116 than closer to the recessed surface 116. In another example, the beam-forming feature 106 may separate each radiation slot 108 from the next one with inner walls running orthogonal to the one or more recessed walls 114. The shape of the beam-forming feature can determine the shape of the main lobe in the radiation pattern. For example, walls of uneven height or a choke may produce an asymmetrical main lobe. Walls that are more recessed farther away may produce a narrower main lobe than walls of uniform width. The beam-forming feature 106, therefore, may provide multiple benefits. It may shape the radiation pattern for use in a particular application, and it may reduce grating lobes which can improve host system effectiveness.

Figures 1, 2:
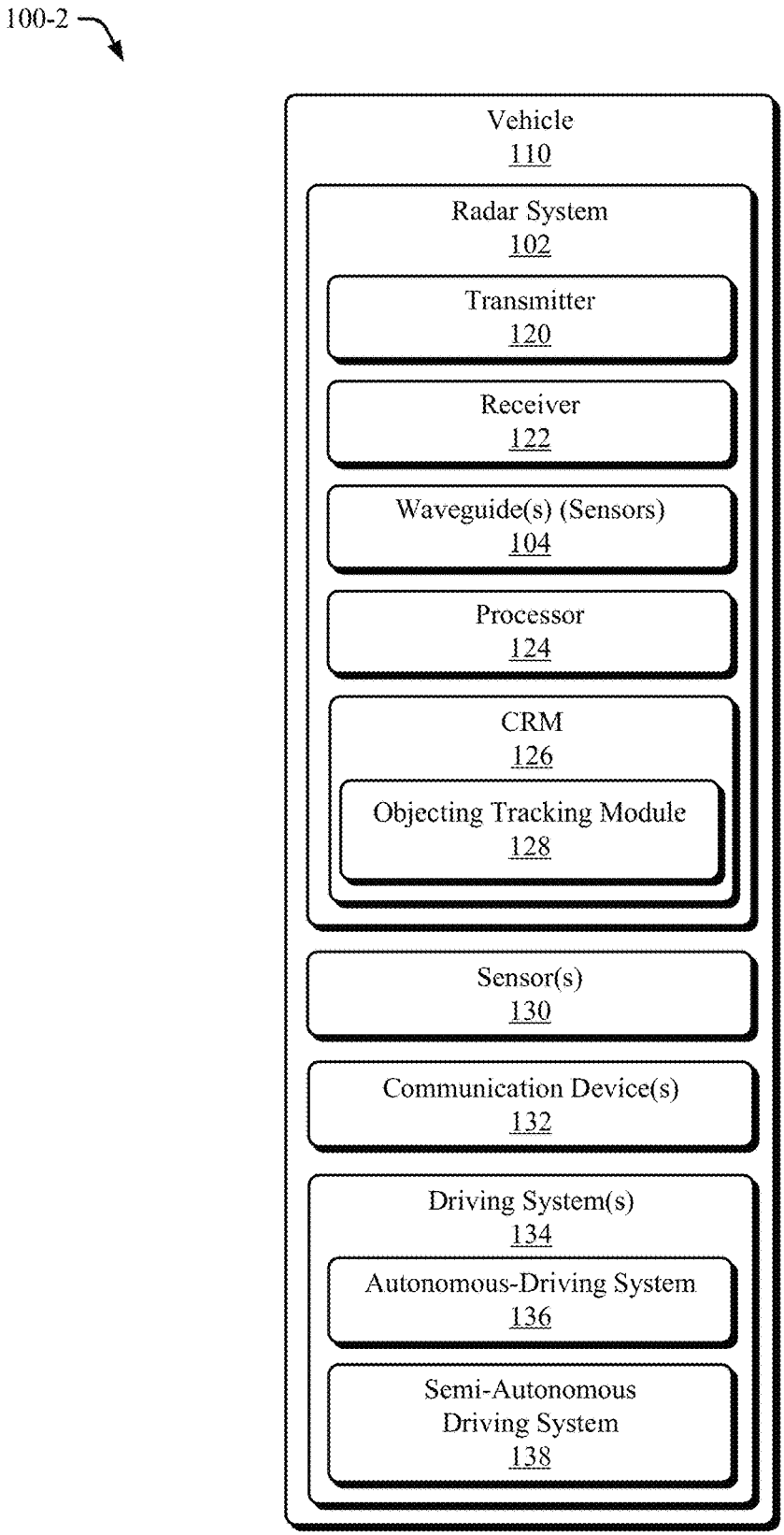
Figure 2:
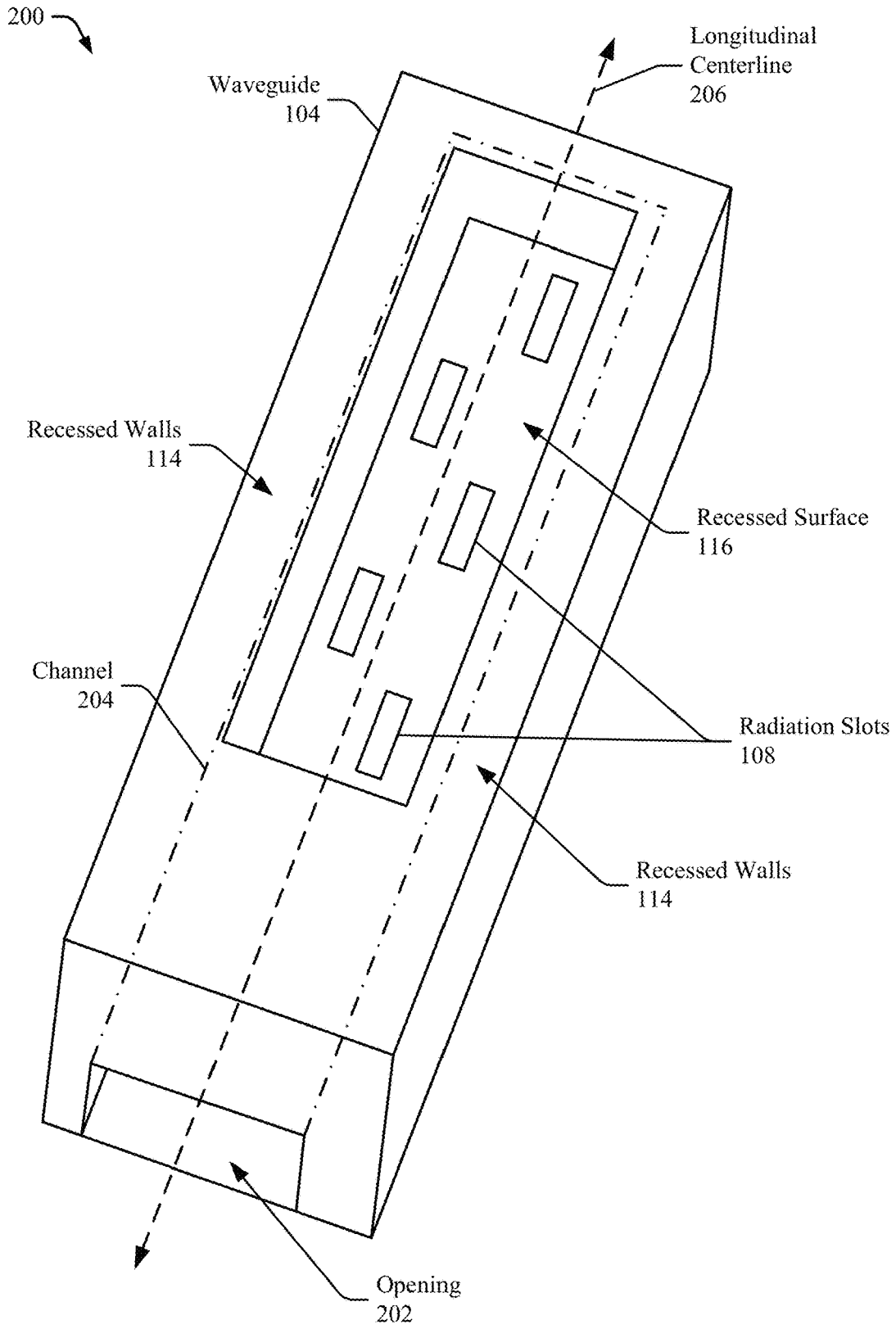

FIG. 1-2 illustrates an example configuration 100-2 of the vehicle 110 that can use the waveguide 104 with the beam-forming feature 106 with radiation slots 108. The vehicle 110 can include the radar system 102. The radar system may include several components such as a transmitter 120, a receiver 122, one or more waveguides 104 (as components of radar sensors), a processor 124, and a CRM 126. The CRM 126 may store different modules (e.g., an object tracking module 128) and configuration information.

The transmitter 120 and the receiver 122 can be on separate integrated circuits, or they can consolidated on a common integrated circuit (e.g., a transceiver integrated circuit). The transmitter 120 emits electromagnetic signals, via the waveguide 104, that may reflect off of objects 112 in the field-of-view 118. The receiver 122 may detect the reflected electromagnetic signals via the waveguide 104. The waveguide 104 may represent one waveguide coupled to one integrated circuit, multiple waveguides coupled to one integrated circuit, or multiple waveguides coupled to multiple integrated circuits.

The processor 124 executes instructions (e.g., the object tracking module 128) stored within the CRM 126. In the example configuration 100-2, the processor 124 can instruct the transmitter 120 to emit electromagnetic signals. The processor 124 can process the reflected electromagnetic signals detected by the receiver 122, and communicate the processed information to driving systems 134.

The vehicle 110 can include the driving systems 134, including an autonomous-driving system 136 or semi-autonomous driving system 138, that use radar data from the radar system 102 to control the vehicle 110.

The vehicle can also include one or more sensors 130, one or more communication devices 132, and the driving systems 134. The sensors 130 can include a location sensor, a camera, a lidar system, or a combination thereof. The location sensor, for example, can include a positioning system that can determine the position of the vehicle 110. The camera system can be mounted on or near the front of the vehicle 110. The camera system can take photographic images or video of a roadway or other nearby scenes in the vicinity of the vehicle 110. In other implementations, a portion of the camera system can be mounted into a rear-view mirror of the vehicle 110 to have a field-of-view of the roadway. In yet other implementations, the camera system can project the field-of-view from any exterior surface of the vehicle 110. For example, vehicle manufacturers can integrate at least a part of the camera system into a side mirror, bumper, roof, or any other interior or exterior location where the field-of-view includes the roadway. The lidar system can use electromagnetic signals to detect the objects 112 (e.g., other vehicles) on the roadway. Data from the lidar system can provide an input to the driving systems 134. For example, the lidar system can determine the traveling speed of a vehicle in front of the vehicle 110 or nearby vehicles traveling in the same direction as the vehicle 110.

The communication devices 132 can be radio frequency (RF) transceivers to transmit and receive RF signals. The transceivers can include one or more transmitters and receivers incorporated together on the same integrated circuit (e.g., a transceiver integrated circuit) or separately on different integrated circuits. The communication devices 132 can be used to communicate with remote computing devices (e.g., a server or computing system providing navigation information or regional speed limit information), nearby structures (e.g., construction zone traffic signs, traffic lights, school zone traffic signs), or nearby vehicles. For example, the vehicle 110 can use the communication devices 132 to wirelessly exchange information with nearby vehicles using vehicle-to-vehicle (V2V) communication. The vehicle 110 can use V2V communication to obtain the speed, location, and heading of nearby vehicles. Similarly, the vehicle 110 can use the communication devices 132 to wirelessly receive information from nearby traffic signs or structures to indicate a temporary speed limit, traffic congestion, or other traffic-related information.

The communication devices 132 can include a sensor interface and a driving system interface. The sensor interface and the driving system interface can transmit data over a communication bus of the vehicle 110, for example, between the radar system 102 and the driving systems 134.

The vehicle 110 also includes at least one driving system 134, such as the autonomous-driving system 136 or the semi-autonomous driving system 138, that relies on data from the radar system 102 to control the operation of the vehicle 110 (e.g., set the driving speed or avoid the object 112). Generally, the driving systems 134 use data provided by the radar system 102 to control the vehicle 110 and perform certain functions. For example, the semi-autonomous driving system 138 can provide adaptive cruise control and dynamically adjust the travel speed of the vehicle 110 based on the presence of the object 112 in front of the vehicle 110. In this example, the data from the radar system 102 can identify the object 112 and its speed in relation to the vehicle 110.

The autonomous-driving system 136 can navigate the vehicle 110 to a particular destination while avoiding the object 112 as identified by the radar system 102. The data provided by the radar system 102 about the object 112 can provide information about the location and/or speed of the object 112 to enable the autonomous-driving system 136 to adjust the speed of the vehicle 110.

FIG. 2 illustrates a detailed view of the waveguide 104 with a beam-forming feature 106 with radiation slots 108. The waveguide 104 may include an opening 202 to a channel 204 filled with a dielectric. In some aspects, the dielectric is air. In other aspects, the dielectric may be other substances with properties of a dielectric. The dielectric substance may be chosen based on particular applications for which the waveguide 104 is being used. The opening 202 and the channel 204 is depicted as being rectangular; however, the opening 202 and the channel 204 may be any shape (e.g., square, elliptical, round) that still retains the properties required of the waveguide 104.

The radiation slots 108 are depicted as being positioned along a longitudinal centerline 206 that runs parallel to the channel 204. Additionally, the radiation slots 108 are placed closer to an end of the waveguide 104 than an end with the opening 202 to the channel 204. In other aspects, the radiation slots may be positioned offset to the longitudinal centerline 206 or closer to the end of the waveguide 104 with the opening 202.

Figures 1, 3:
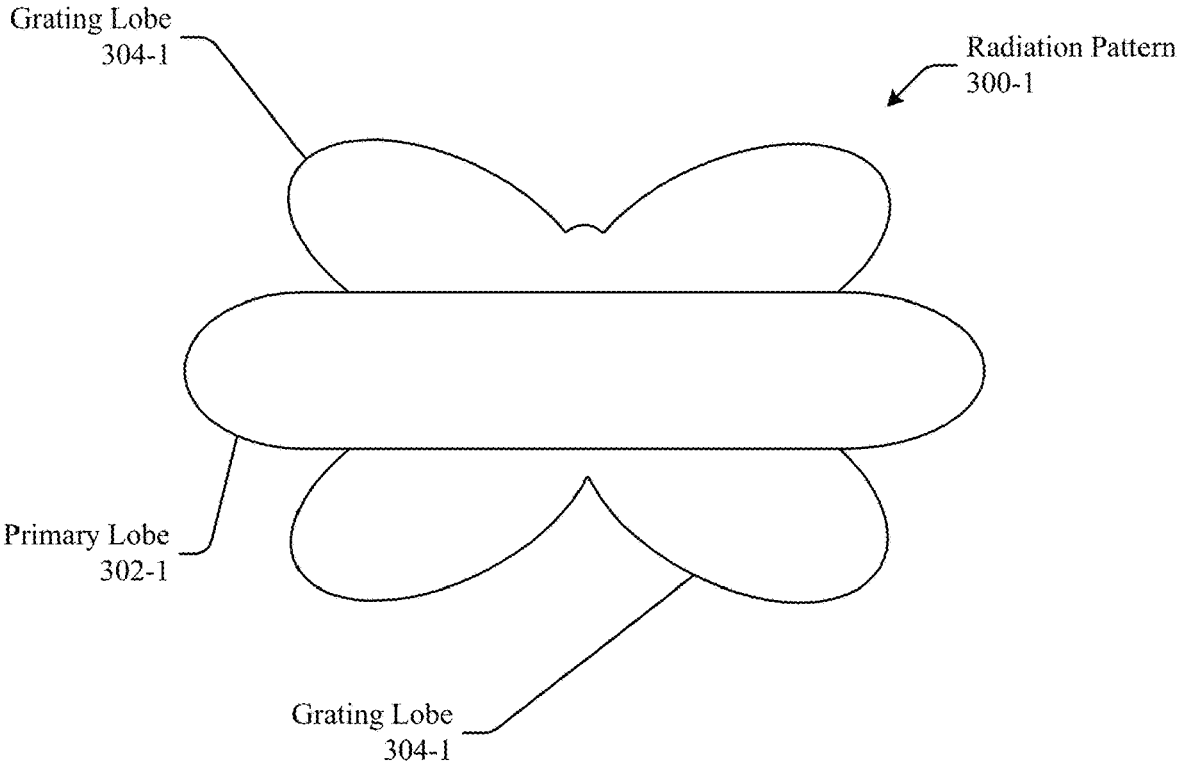
Figures 2, 3:
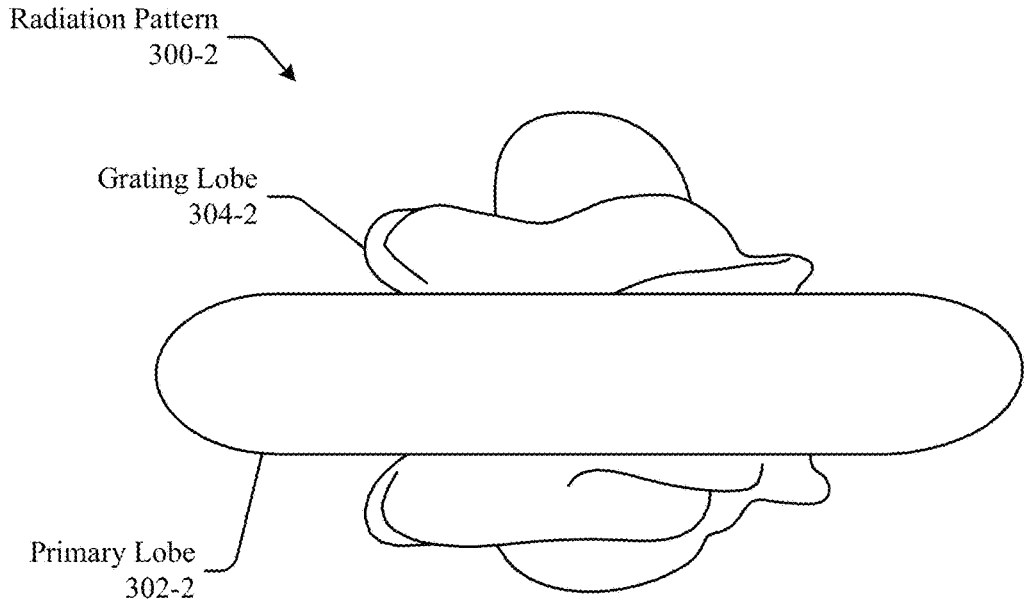

FIG. 3-1 illustrates a radiation pattern 300-1 associated with an example waveguide without a beam-forming feature with radiation slots. The example waveguide without a beam-forming feature with radiation slots can generate a main lobe 302-1, but the radiation pattern 300-1 may include grating lobes 304-1 that can negatively impact the accuracy of the host system (e.g., the radar system 102 from FIG. 1).

In contrast to FIG. 3-1, FIG. 3-2 illustrates a radiation pattern associated with an example waveguide with a beam-forming feature with radiation slots similar to the waveguide 104 from FIG. 1. The example waveguide with a beam-forming feature with radiation slots generates a main lobe 302-2 similar to main lobe 302-1; however, grating lobes have been dramatically reduced in size and intensity relative to the grating lobes 304-1. The reduced size and intensity of the grating lobes 304-2 may lessen false-positive detections by the host system.

The details of the beam-forming feature 106 are described below with respect to FIGS. 4 through 9. Generally, the beam-forming feature 106 shapes the radiation pattern 300-2 of the waveguide 104 for a particular application as well as reducing grating lobes. For example, depending on the shapes of its one or more recessed walls, the beam-forming feature 106 may either narrow or widen the main lobe 302-2 in the radiation pattern. Recessed walls of different heights or the inclusion of a choke may produce an asymmetric main lobe 302-2 (not depicted) in the radiation pattern 300-2 generated by the waveguide 104. Using the waveguide 104 for radar applications in vehicles 110 may contribute to greater reliability of a host system and increased safety for vehicles 110.

Example Beam-Forming Features

Figures 1, 4:
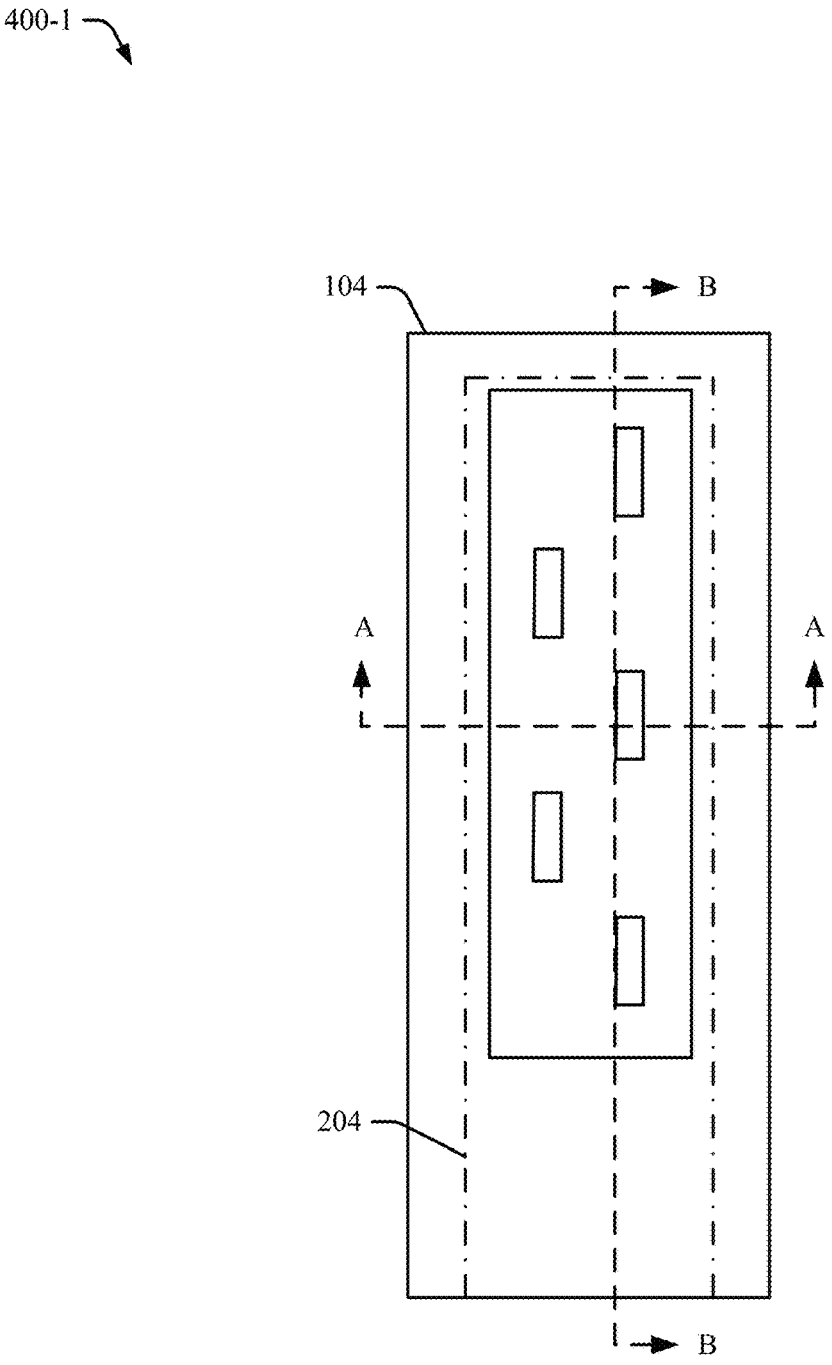
Figures 2, 4:
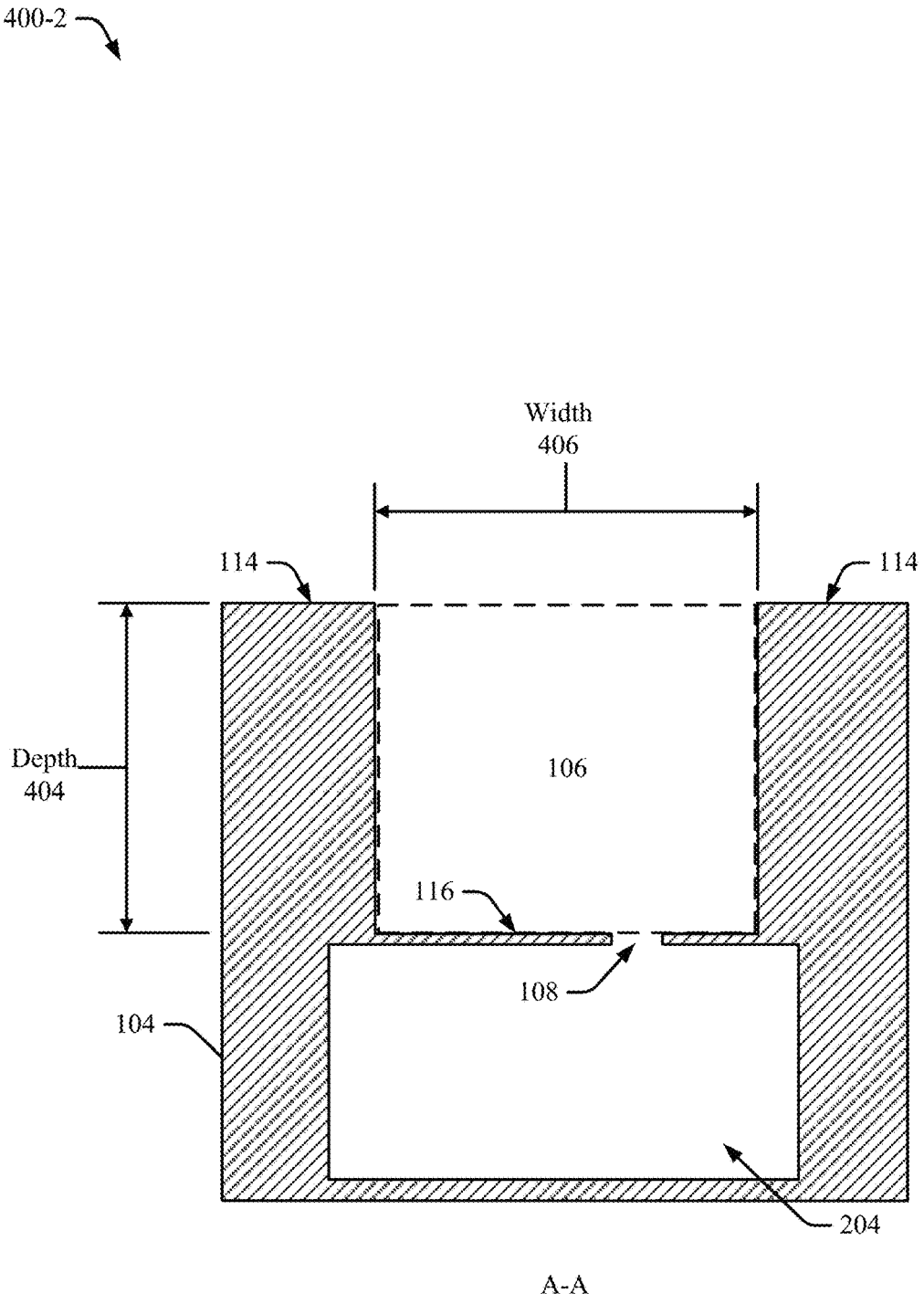
Figures 3, 4:
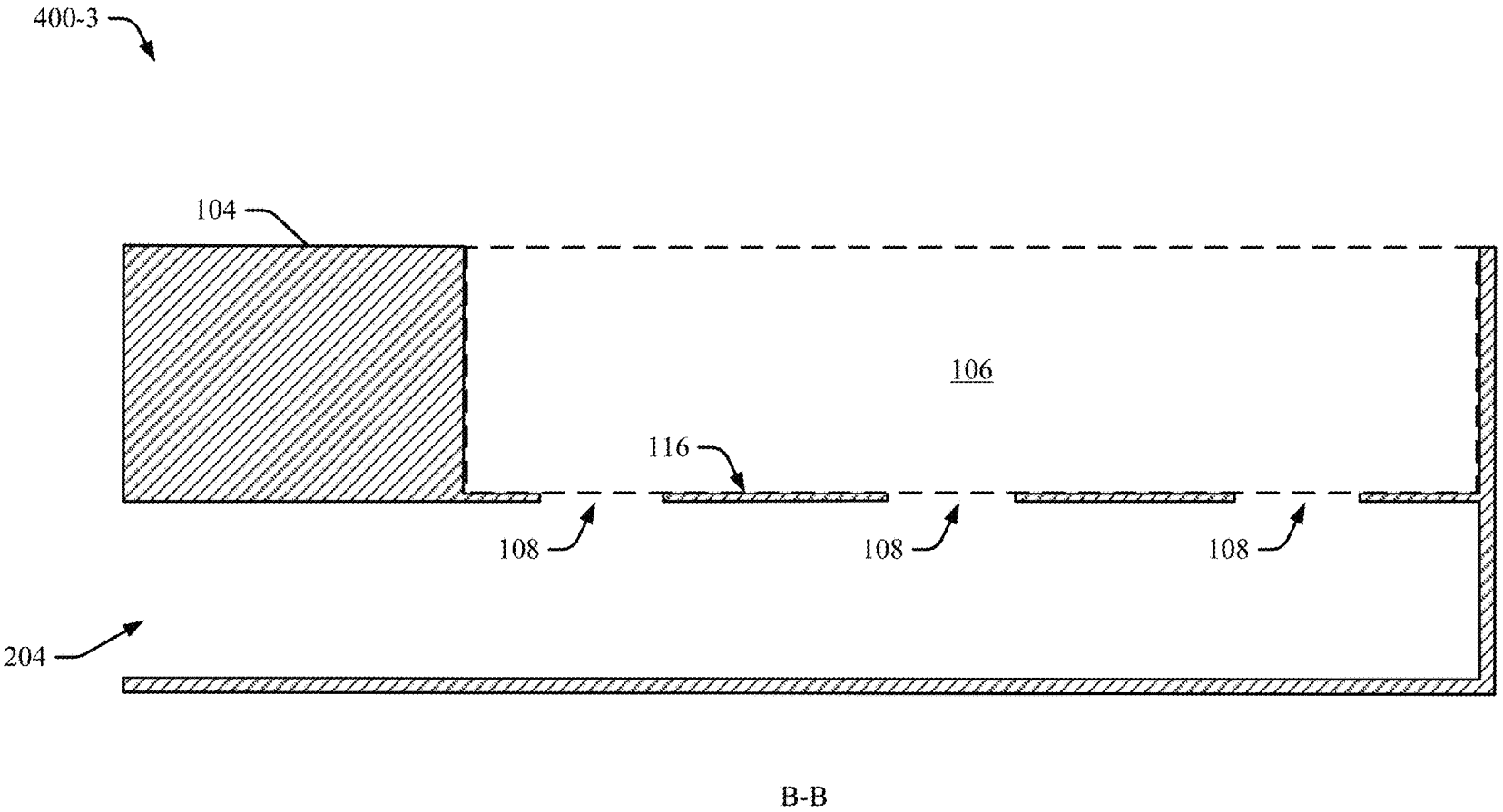

FIG. 4-1 illustrates a top view 400-1 of the waveguide 104 with the beam-forming feature 106 with radiation slots 108. Sectional lines A-A and B-B represent the cuts made for cross-sectional views illustrated in FIGS. 4-2 and 4-3, respectfully. The waveguide 104 from FIG. 1 is used as the example waveguide for FIGS. 4-1 to 4-3. In other aspects, the features of the waveguide 104 may vary by physical or electromagnetic properties as required for a particular application. For example, the quantity of radiation slots, or the shape and length of the channel can vary.

FIG. 4-2 illustrates a lateral cross-section view 400-2 of a waveguide with a beam-forming feature with radiation slots. The recessed walls 114 and the recessed surface 116 form boundaries of the beam-forming feature 106. The radiation slots 108 provide openings between the channel 204 and the beam-forming feature 106. The beam-forming feature 106 has a depth 404 and a width 406. In some aspects, the depth 404 is at least equal to or greater than the width 406.

FIG. 4-3 illustrates a longitudinal cross-section view of a waveguide with a beam-forming feature with radiation slots.

The beam-forming feature 106 surrounds the radiation slots 108 on the recessed surface 116. In this example, the beam-forming feature 106 is depicted as being closer to an end of the waveguide away from the opening of the channel 204. In some aspects, the beam-forming feature 106 may be symmetrical to along the longitudinal direction of the waveguide 104, or it may be closer to the end of the waveguide 104 with the opening to the channel 204. The position of the beam-forming feature 106 is such that it encompasses the radiation slots 108 wherever they are positioned on the recessed surface 116.

Figure 5:
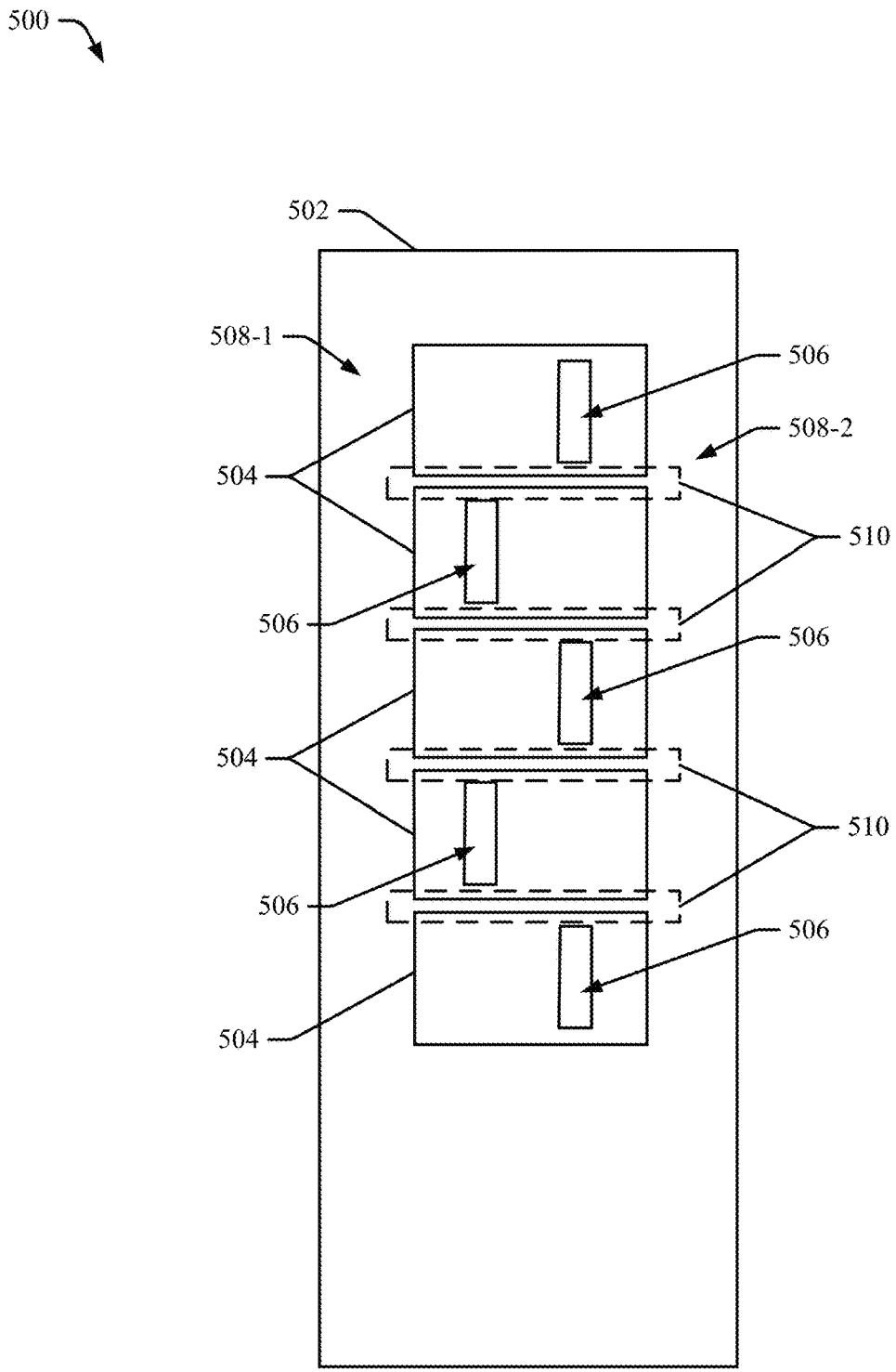
FIG. 5 illustrates an example of a waveguide with a beam-forming feature with radiation slots in which the beam-forming feature is subdivided into multiple sections with each section encompassing a radiation slot, in accordance with techniques, apparatuses, and systems of this disclosure.

FIG. 5 illustrates an example 500 of a waveguide 502 with a beam-forming feature with radiation slots 506 in which the beam-forming feature is subdivided into multiple sections 504 with each section 504 encompassing a radiation slot 506. Each section 504 is formed by adding a wall 510 between each radiation slot 506 that extends orthogonally from recessed wall 508-1 to recessed wall 508-2. The multiple sections 504 are illustrated as being of equal length. In other aspects, the sections 504 may be shaped differently. Some non-limiting examples include the inner walls of the multiple sections 504 which may have either a concave or a convex curve, or either the recessed wall 508-1 or 508-2 may be thicker in some of the sections 504 than in the other sections 504. Likewise, other examples of the sections 504 may be implemented. The radiation pattern of the waveguide 502 can be similar to the waveguide 104. The waveguide 502 may be used if, for example, structural requirements of the beam-forming feature requires the added walls 510.

Figure 6:
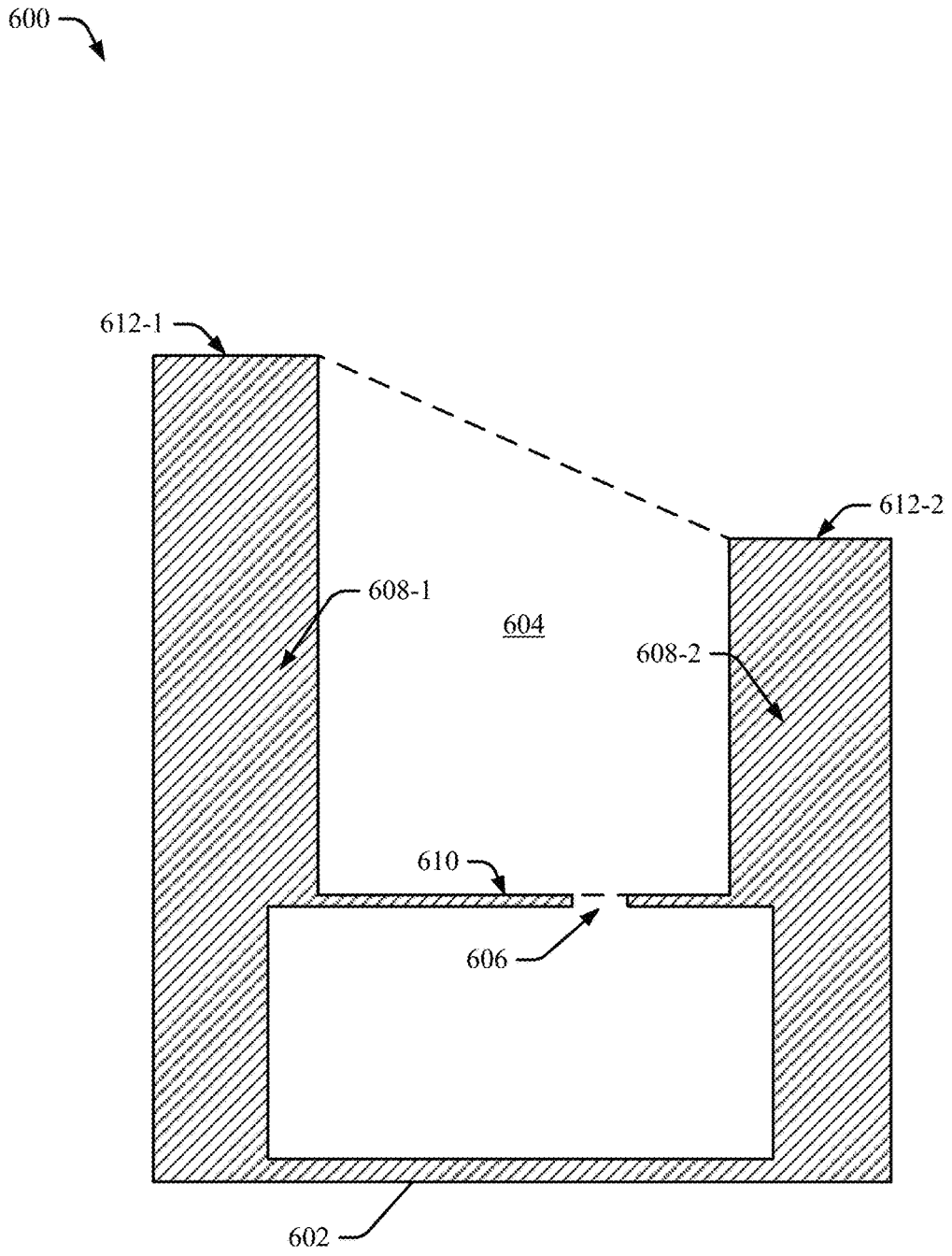
FIG. 6 illustrates an example of a waveguide with a beam-forming feature with radiation slots in which a first recessed wall of the beam-forming feature has a height that is greater than a second recessed wall that is parallel to the first recessed wall, in accordance with techniques, apparatuses, and systems of this disclosure.

FIG. 6 illustrates an example 600 of a waveguide 602 with a beam-forming feature 604 with radiation slots 606 in which a first recessed wall 608-1 of the beam-forming feature has a height that is greater than a second recessed wall 608-2 that is parallel to the first recessed wall 608-1. The beam-forming feature 604 is shaped by the first recessed wall 608-1, the second recessed wall 608-2, and a recessed surface 610. The height of the first recessed wall 608-1 is measured from the recessed surface 610 to an outer surface 612-1 of the first recessed wall 608-1 that is parallel to the recessed surface 610. Likewise, the height of the second recessed wall 608-2 is measured from a recessed surface 610 to an outer surface 612-2 of the second recessed wall 608-2 that is parallel to the recessed surface 610. The beam-forming feature 604 may generate an asymmetric main lobe in addition to reducing grating lobes.

Figure 7:
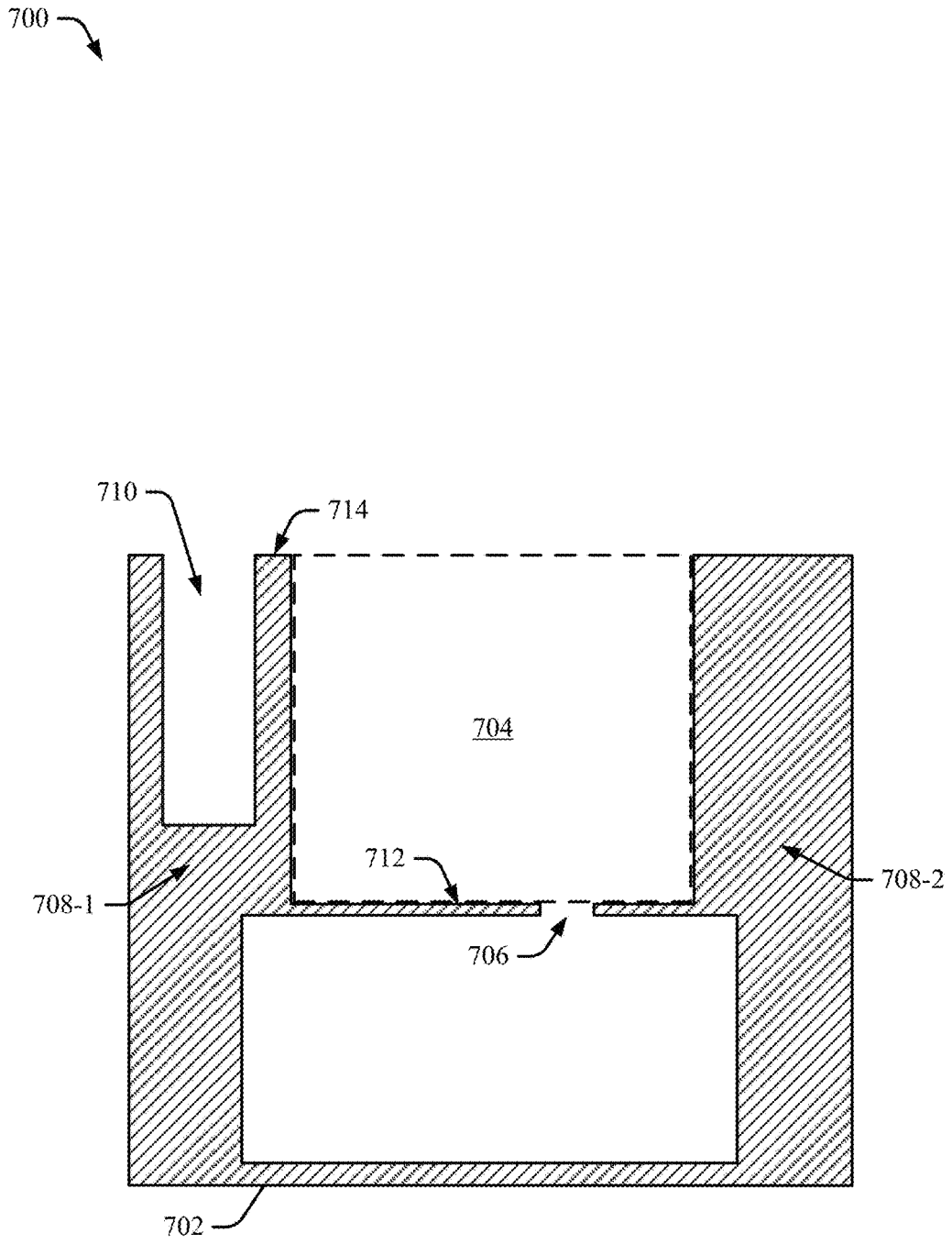
FIG. 7 illustrates an example of a waveguide with a beam-forming feature with radiation slots in which one recessed wall of the beam-forming feature includes a choke, in accordance with techniques, apparatuses, and systems of this disclosure.

FIG. 7 illustrates an example 700 of a waveguide 702 with a beam-forming feature 704 with radiation slots 706 in which one recessed wall 708-1 of the beam-forming feature includes a choke 710. The recessed walls 708-1 and 708-2 and the recessed surface 712 form the beam-forming feature 704. Additionally, the choke 710 in the recessed wall 708-1 can be a trough in the outer surface 714 of the wall that is parallel to the recessed surface 712. The choke 710 may be used to form an asymmetric main lobe in the radiation pattern generated by the waveguide 702.

Figure 8:
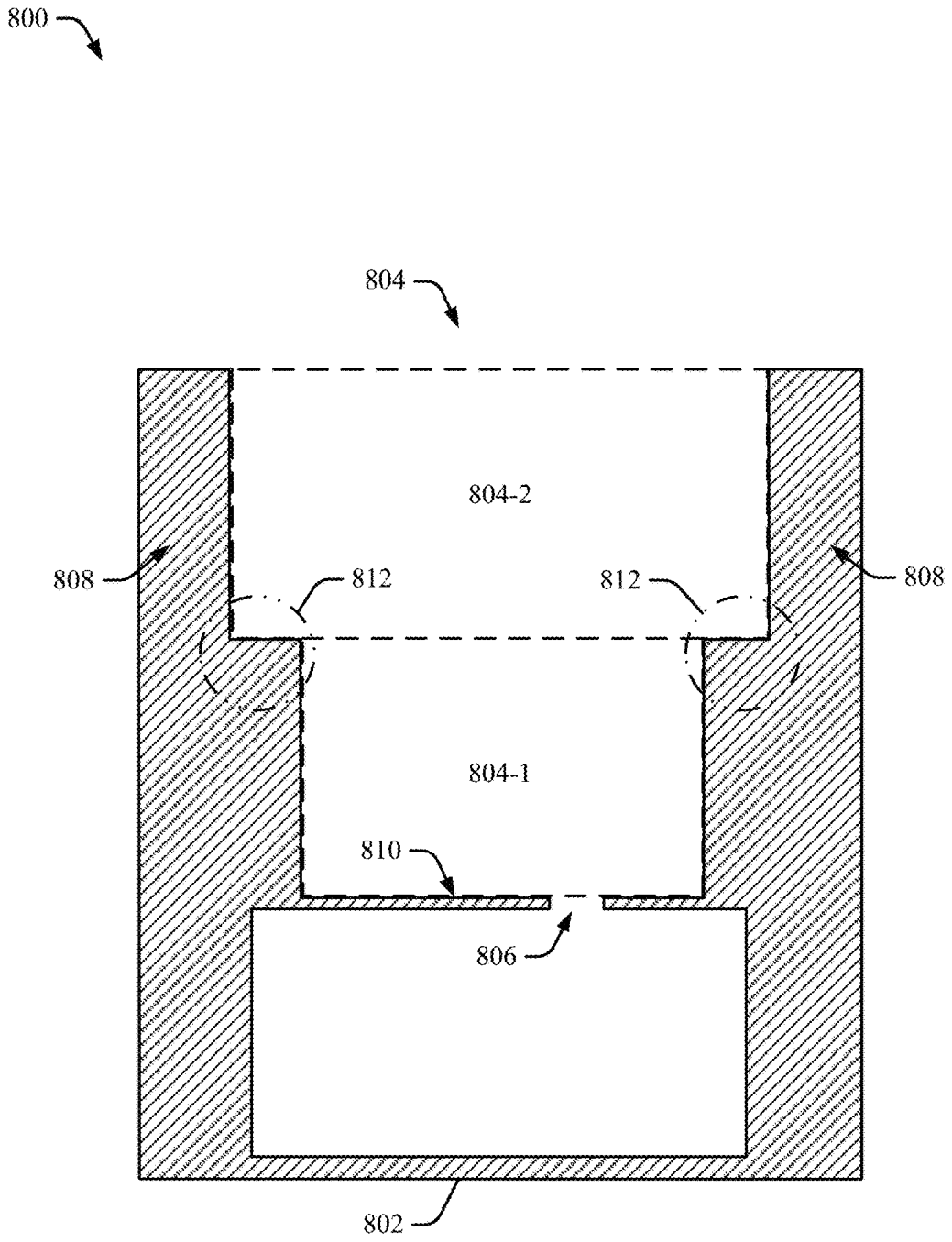
FIG. 8 illustrates an example of a waveguide with a beam-forming feature with radiation slots in which one or more recessed walls of the beam-forming feature forms a first portion and a second portion of the beam-forming feature, in accordance with techniques, apparatuses, and systems of this disclosure.

FIG. 8 illustrates an example 800 of a waveguide 802 with a beam-forming feature 804 with radiation slots 806 in which one or more recessed walls 808 of the beam-forming feature 804 forms a first portion 804-1 and a second portion 804-2 of the beam-forming feature 804. In the example 800, the first portion 804-1 of the beam-forming feature 804 is positioned between a recessed surface 810 and the second portion 804-2 of the beam-forming feature 804. The first portion 804-1 can have a smaller width than the second portion 804-2. The widths of the first portion 804-1 and second portion 804-2 are measured as a distance between inner surfaces of the recessed walls 808. As illustrated, the inner surface of each wall 808 has a step feature 812. The step feature 812 transitions the narrower first portion 804-1 of the beam-forming feature 804 to the wider second portion 804-2 of the beam-forming feature 804. Alternatively, more step features may be added to the one or more recessed walls 808 creating an additional portion of the beam-forming feature 804 for each step feature added. The beam-forming feature 804 may generate a narrower main lobe compared to other examples of the beam-forming feature with straight walls (e.g., the beam-forming feature 106 as illustrated in FIG. 4-2).

Figure 9:
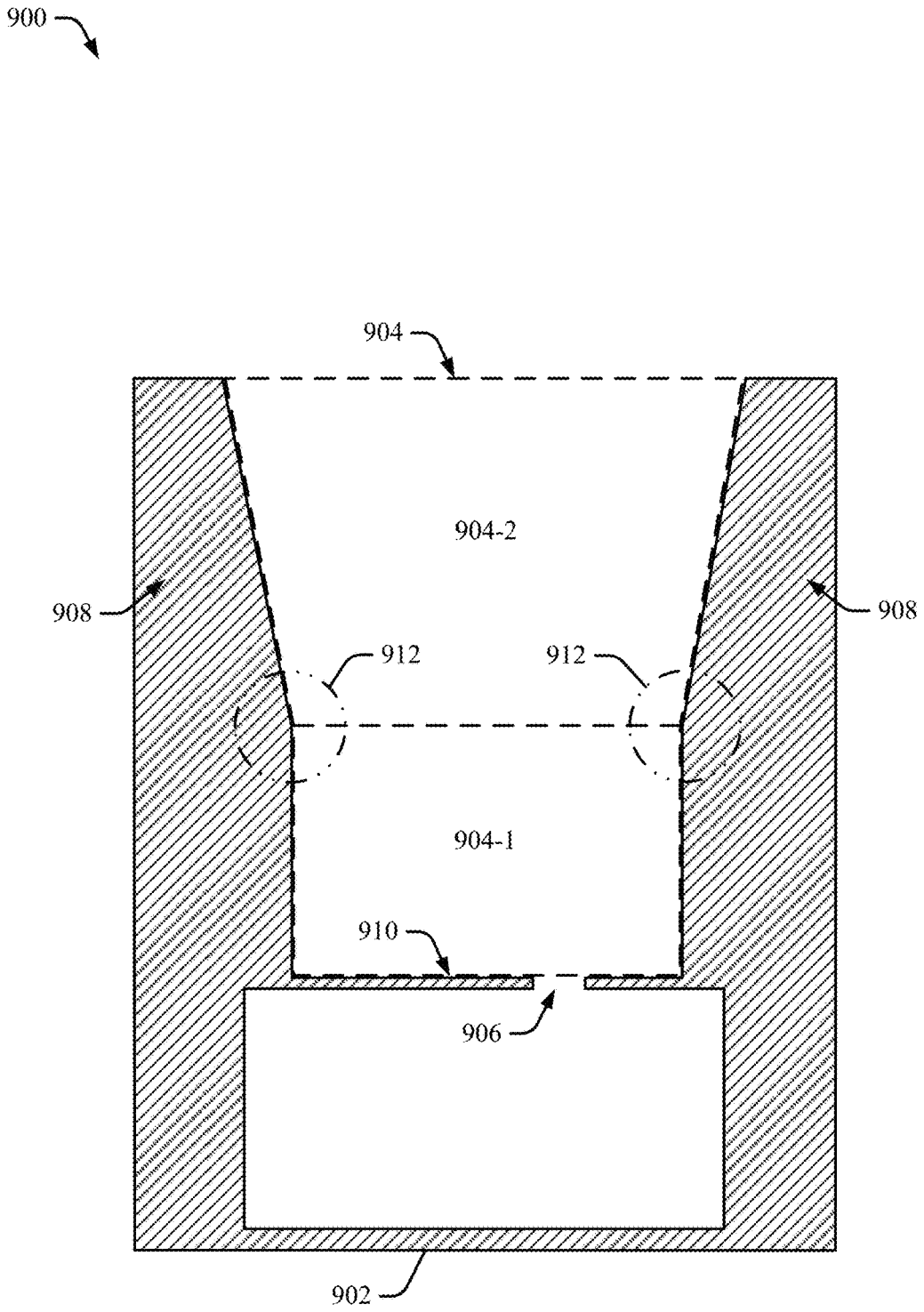
FIG. 9 illustrates another example of a waveguide with a beam-forming feature with radiation slots in which one or more recessed walls of the beam-forming feature forms a first portion and a second portion of the beam-forming feature, in accordance with techniques, apparatuses, and systems of this disclosure.

FIG. 9 illustrates another example 900 of a waveguide 902 with a beam-forming feature 904 with radiation slots 906 in which one or more recessed walls 908 of the beam-forming feature 904 forms a first portion 904-1 and a second portion of the beam-forming feature 904. Similar to example 800 in FIG. 8, in the example 900, the first portion 904-1 of the beam-forming feature 904 is positioned between a recessed surface 910 and the second portion 904-2 of the beam-forming feature 904. At transition points 912, inner surfaces of the recessed walls 908 taper out. The tapering of the inner surfaces of the recessed walls 908 at the transition points 912 forms a width, measured as the distance between the inner surfaces, that continuously widens. This creates a horn effect of the beam-forming feature 904. In alternative aspects of example 900, the transition points 912 can be positioned at any location along the inner surfaces of the recessed walls 908 including at the points where the inner surfaces of the recessed walls 908 abut the recessed surface 910. Likewise, similar to example 800, example 900 may generate a narrower main lobe relative to other examples described herein.

Example Method

Figure 10:
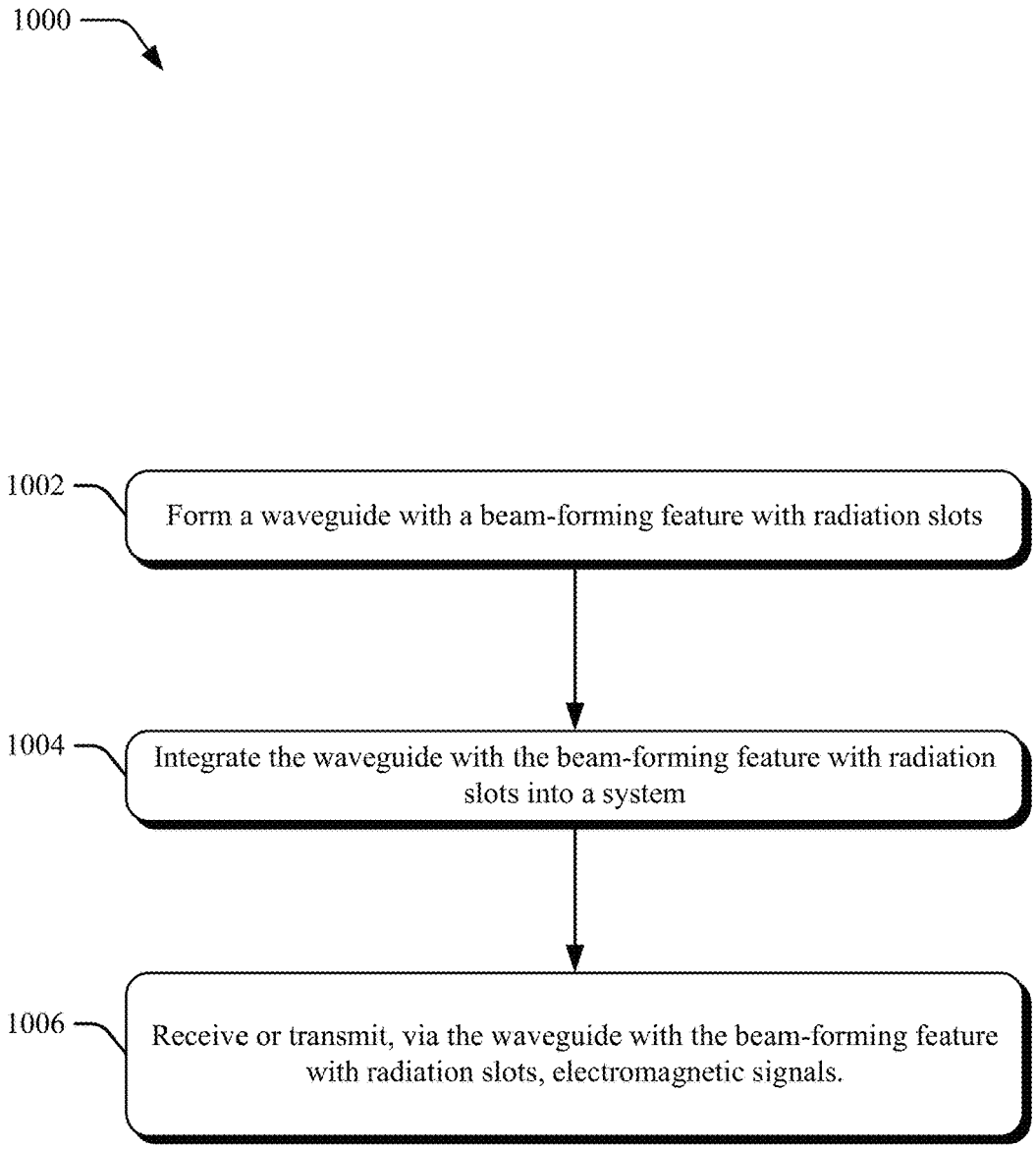
FIG. 10 illustrates an example method of manufacturing a waveguide with a beam-forming feature with radiation slots.

FIG. 10 illustrates an example method of manufacturing a waveguide with a beam-forming feature with radiation slots. Method 1000 is shown as sets of operations (or acts) performed, but not necessarily limited to the order or combinations in which the operations are shown herein. Further, any of one or more of the operations may be repeated, combined, or reorganized to provide other methods. In portions of the following discussion, reference may be made to the environment 100 of FIG. 1 and entities detailed in FIGS. 1 through 9, reference to which is made for example only. The techniques are not limited to performance by one entity or multiple entities.

At 1002, a waveguide with a beam-forming feature with radiation slots is formed. For example, the waveguide 104, 502, 602, 702, 802, or 902 can be stamped, etched, cut, machined, cast, molded, or formed in some other way.

At 1004, the waveguide with a beam-forming feature with radiation slots is integrated into a system. For example, the waveguide 104, 502, 602, 702, 802, or 902 is electrically coupled to at least a receiver, transmitter, or transceiver of radar system 102.

At 1006, electromagnetic signals are received or transmitted via the waveguide with a beam-forming feature with radiation slots. For example, the waveguide 104, 502, 602, 702, 802, or 902 receives or transmits signals that are routed through the radar system 102.

Including a beam-forming feature on a waveguide may reduce grating lobes significantly, thus, improving the accuracy of the host system coupled to the waveguide. Additionally, different aspects of the beam-forming feature may adjust the width of the beam, either narrower or wider, or generate an asymmetric beam. These different aspects enable the waveguide with a beam-forming feature with radiation to be used for several purposes, especially in applications where a beam of a certain width or direction is required for better performance.

ADDITIONAL EXAMPLES

In the following section, examples are provided.

Example 1: An apparatus, the apparatus comprising: a waveguide configured to guide electromagnetic energy through an opening at a first end of at least one channel filled with a dielectric, the waveguide comprising: two parallel surfaces of the waveguide that form a ceiling and a floor of the channel filled with the dielectric; an adjoining surface orthogonal to the two surfaces that forms walls of the channel filled with the dielectric; and a beam-forming feature that defines one or more recessed walls surrounding to provide a recessed surface through which a plurality of radiation slots include openings to the channel filled with the dielectric.

Example 2: The apparatus of example 1, wherein the beam-forming feature has a depth, the depth being measured from the opening of the beam-forming feature to the recessed surface and being at least equal or greater to a width, the width being measured from an inner surface of a first wall of the one or more recessed walls to an inner surface of a second wall of the one or more recessed walls parallel to the first wall of the one or more recessed walls.

Example 3: The apparatus of example 1, wherein the beam-forming feature is subdivided into multiple sections of equal length, each section encompassing one radiation slot of the plurality of radiation slots.

Example 4: The apparatus of example 1, wherein a first wall of the one or more recessed walls has a height that is greater than a height of a second wall of the one or more recessed walls, the second wall of the one or more recessed walls being parallel to the first wall of the one or more recessed walls.

Example 5: The apparatus of example 1, wherein a first wall of the one or more recessed walls comprises a choke, the choke comprising a trough positioned on an outer surface of the first wall, the outer surface being parallel to the recessed surface.

Example 6: The apparatus of any of examples 1 through 5, wherein the one or more recessed walls comprise: a first portion of the beam-forming feature that is adjoined to and arranged between the recessed surface and a second portion of the beam-forming feature of the one or more recessed walls, the second portion of the beam-forming feature having a second width, the second width measured from parallel inner surfaces of the second portion, and is greater than a first width of the first portion, the first width measured from parallel inner surfaces of the first portion.

Example 7: The apparatus of example 6, wherein the inner surfaces of the second portion taper out from the inner surfaces of the first portion, the second portion forming a horn effect defined by the tapering of the inner surfaces of the second portion.

Example 8: The apparatus of any of examples 1 through 7, wherein the plurality of radiation slots is positioned along a centerline of the channel, the centerline being parallel with a longitudinal direction through the channel.

Example 9: The apparatus of any of examples 1 through 8, wherein the dielectric comprises air and the waveguide comprises an air waveguide.

Example 10: A system comprising: a device configured to transmit or receive an electromagnetic energy; and a waveguide antenna configured to guide electromagnetic energy through an opening at one end of at least one channel filled with a dielectric, the waveguide comprising: two parallel surfaces of the waveguide that form a ceiling and a floor of the channel filled with the dielectric; an adjoining surface orthogonal to the two surfaces that forms walls of the channel filled with the dielectric; and a beam-forming feature that defines one or more recessed walls surrounding to provide a recessed surface through which a plurality of radiation slots include openings to the channel filled with the dielectric.

Example 11: The system of example 10, wherein the beam-forming feature has a depth, the depth being measured from the opening of the beam-forming feature to the recessed surface and being at least equal or greater to a width, the width being measured from an inner surface of a first wall of the one or more recessed walls to an inner surface of a second wall of the one or more recessed walls parallel to the first wall of the one or more recessed walls.

Example 12: The system of example 10, wherein the beam-forming feature is subdivided into multiple sections of equal length, each section encompassing one radiation slot of the plurality of radiation slots.

Example 13: The system of example 10, wherein a first wall of the one or more recessed walls has a height that is greater than a height of a second wall of the one or more recessed walls, the second wall of the one or more recessed walls being parallel to the first wall of the one or more recessed walls.

Example 14: The system of example 10, wherein a first wall of the one or more recessed walls comprises a choke, the choke comprising a trough positioned on an outer surface of the first wall, the outer surface being parallel to the recessed surface.

Example 15: The system of example 10, wherein the one or more recessed walls comprise: a first portion of the beam-forming feature that is adjoined to and arranged between the recessed surface and a second portion of the beam-forming feature of the one or more recessed walls, the second portion of the beam-forming feature having a second width, the second width measured from parallel inner surfaces of the second portion, and is greater than a first width of the first portion, the first width measured from parallel inner surfaces of the first portion.

Example 16: The system of example 15, wherein the inner surfaces of the second portion taper out from the inner surfaces of the first portion, the second portion forming a horn effect defined by the tapering of the inner surfaces of the second portion.

Example 17: The system of any of examples 10 through 16, wherein the plurality of radiation slots is positioned along a centerline of the channel, the centerline being parallel with a longitudinal direction through the channel.

Example 18: The system of any of examples 10 through 17, wherein the dielectric comprises air and the waveguide comprises an air waveguide.

Example 19: The system of any of examples 10 through 18, wherein the device comprises a radar system.

Example 20: The system of example 19, wherein the system is a vehicle configured to drive on or off road.

CONCLUSION

While various embodiments of the disclosure are described in the foregoing description and shown in the drawings, it is to be understood that this disclosure is not limited thereto but may be variously embodied to practice within the scope of the following claims. From the foregoing description, it will be apparent that various changes may be made without departing from the scope of the disclosure as defined by the following claims.

What is claimed is:

1. An apparatus comprising:

a waveguide configured to guide electromagnetic energy through an opening at a first end of at least one channel filled with a dielectric, the waveguide comprising:

two parallel surfaces of the waveguide that form a ceiling and a floor of the channel filled with the dielectric;

adjoining surfaces orthogonal to the two surfaces that form walls of the channel filled with the dielectric; and a beam-forming feature comprising two recessed walls separated by a plurality of radiation slots, the two recessed walls configured to provide a recessed surface through which the plurality of radiation slots include openings to the channel filled with the dielectric, a first wall of the two recessed walls running parallel to a longitudinal axis of the waveguide, a second wall of the two recessed walls running parallel to the first wall and having a height that is less than that of the first wall.

2. The apparatus of claim 1, wherein the beam-forming feature has a depth, the depth being measured from the opening of the beam-forming feature to the recessed surface and being at least equal or greater to a width, the width being measured from an inner surface of the first wall of the two recessed walls to an inner surface of the second wall of the two recessed walls.

3. The apparatus of claim 1, wherein the beam-forming feature is subdivided into multiple sections of equal length, each section encompassing one radiation slot of the plurality of radiation slots.

4. The apparatus of claim 1, wherein the first wall of the two recessed walls comprises a choke, the choke comprising a trough positioned on an outer surface of the first wall, the outer surface being parallel to the recessed surface.

5. The apparatus of claim 1, wherein the two recessed walls comprise:

a first portion of the beam-forming feature that is adjoined to and arranged between the recessed surface and a second portion of the beam-forming feature of the two recessed walls; and the second portion of the beam-forming feature having a second width, the second width measured from parallel inner surfaces of the second portion, and is greater than a first width of the first portion, the first width measured from parallel inner surfaces of the first portion.

6. The apparatus of claim 5, wherein the inner surfaces of the second portion taper out from the inner surfaces of the first portion, the second portion forming a horn effect defined by the tapering of the inner surfaces of the second portion.

7. The apparatus of claim 1, wherein the plurality of radiation slots is positioned along a centerline of the channel, the centerline being parallel with the longitudinal axis through the channel.

8. The apparatus of claim 1, wherein the dielectric comprises air and the waveguide comprises an air waveguide.

9. The apparatus of claim 1, wherein the second wall of the two recessed walls comprises a choke, the choke comprising a trough positioned on an outer surface of the second wall, the outer surface being parallel to the recessed surface.

10. A system comprising:

a device configured to transmit or receive an electromagnetic energy; and a waveguide configured to guide electromagnetic energy through an opening at one end of at least one channel filled with a dielectric, the waveguide comprising:

two parallel surfaces of the waveguide that form a ceiling and a floor of the channel filled with the dielectric;

adjoining surfaces orthogonal to the two surfaces that form walls of the channel filled with the dielectric; and a beam-forming feature that defines two recessed walls separated by a plurality of radiation slots, the two recessed walls configured to provide a recessed surface through which the plurality of radiation slots include openings to the channel filled with the dielectric, a first wall of the two recessed walls running parallel to a longitudinal axis of the waveguide, a second wall of the two recessed walls running parallel to the first wall and having a height that is less than that of the first wall.

11. The system of claim 10, wherein the beam-forming feature has a depth, the depth being measured from the opening of the beam-forming feature to the recessed surface and being at least equal or greater to a width, the width being measured from an inner surface of the first wall of the two recessed walls to an inner surface of the second wall of the two recessed walls.

12. The system of claim 10, wherein the beam-forming feature is subdivided into multiple sections of equal length, each section encompassing one radiation slot of the plurality of radiation slots.

13. The system of claim 10, wherein the first wall of the two recessed walls comprises a choke, the choke comprising a trough positioned on an outer surface of the first wall, the outer surface being parallel to the recessed surface.

14. The system of claim 10, wherein the two recessed walls comprise:

a first portion of the beam-forming feature that is adjoined to and arranged between the recessed surface and a second portion of the beam-forming feature of the two recessed walls; and the second portion of the beam-forming feature having a second width, the second width measured from parallel inner surfaces of the second portion, and is greater than a first width of the first portion, the first width measured from parallel inner surfaces of the first portion.

15. The system of claim 14, wherein the inner surfaces of the second portion taper out from the inner surfaces of the first portion, the second portion forming a horn effect defined by the tapering of the inner surfaces of the second portion.

16. The system of claim 10, wherein the plurality of radiation slots is positioned along a centerline of the channel, the centerline being parallel with the longitudinal axis through the channel.

17. The system of claim 10, wherein the dielectric comprises air and the waveguide comprises an air waveguide.

18. The system of claim 10, wherein the device comprises a radar system.

19. The system of claim 18, wherein the system is a vehicle configured to drive on or off road.

20. The system of claim 10, wherein the second wall of the two recessed walls comprises a choke, the choke comprising a trough positioned on an outer surface of the second wall, the outer surface being parallel to the recessed surface.

* * * * *